United States Patent [19]

Weber

[11] Patent Number: 4,825,801

[45] Date of Patent: May 2, 1989

[54] TAMPER INDICATING SEAL AND METHOD FOR MAKING THE SAME

[75] Inventor: Paul A. Weber, Elgin, Okla.

[73] Assignee: The United States of America as represented by The Director of National Security, Ft. George G. Meade, Md.

[21] Appl. No.: 105,371

[22] Filed: Oct. 5, 1987

[51] Int. Cl.[4] ..... B65D 55/02

[52] U.S. Cl. ..... 116/201; 215/250; 215/252; 215/230; 206/807; 350/442; 350/105; 340/572

[58] Field of Search ..... 116/200, 201, 202, 206, 116/215, 307; 206/459, 497, 534, 807; 215/201, 211, 230, 232, 203, 246, 250, 231, 252, 253, 255, 256, 260, 330; 220/214; 428/916, 918, 411.11, 195.43; 340/568, 572; 350/166, 105, 165, 442; 324/557, 110, 525

[56] References Cited

U.S. PATENT DOCUMENTS

| | | | |
|---|---|---|---|
| 3,935,960 | 2/1976 | Cornell | 220/260 |
| 4,262,284 | 4/1981 | Stieff et al. | 340/568 |
| 4,451,530 | 5/1984 | Kaule et al. | 428/323 |
| 4,475,661 | 10/1984 | Griffin | 215/230 X |
| 4,480,760 | 11/1984 | Schonberger | 215/230 |
| 4,496,618 | 1/1985 | Pernicano | 350/105 X |
| 4,502,605 | 3/1985 | Wloszczyna | 215/230 |
| 4,511,054 | 4/1985 | Shank | 215/252 |
| 4,516,679 | 5/1985 | Simpson et al. | 206/459 |
| 4,576,297 | 3/1986 | Larson | 215/250 |
| 4,630,891 | 12/1986 | Li | 350/105 |
| 4,685,579 | 8/1987 | Stapleton | 215/230 |
| 4,711,368 | 12/1987 | Simons | 340/572 X |
| 4,712,868 | 12/1987 | Tung et al. | 350/442 X |
| 4,721,217 | 1/1988 | Phillips et al. | 206/807 X |

*Primary Examiner*—William M. Shoop, Jr.
*Assistant Examiner*—Paul Ip
*Attorney, Agent, or Firm*—John R. Utermohle; Thomas O. Maser

[57] ABSTRACT

An improved tamper indicating seal is disclosed, characterized by the generation of a unique signature pattern which, if altered, is indicative of tampering. The seal includes a layer of transparent material which is applied to at least a portion of a secure object or container. A plurality of particles of refective material are randomly arranged within the layer in a unique orientation. When the seal is exposed to light, the particles reflect a portion of the light to produce a unique reflective pattern which corresponds with the orientation of the particles. Alteration of the particle orientation as a result of tampering alters the reflective pattern. Thus when the reflected pattern of a seal does not correspond with its original signature pattern, tampering is indicated.

18 Claims, 2 Drawing Sheets

TAMPER INDICATING SEAL AND METHOD FOR MAKING THE SAME

BACKGROUND OF THE DISCLOSURE

The present invention relates to a tamper indicating or revealing seal for use in connection with containers or other objects. The seals may be applied to medicine bottles, briefcases, electronic devices and components, safety deposit boxes and the like which are intended to be kept secure from undesirable or unwarranted intrusions. Any tampering or altering of the seal is indicated to the prospective purchaser or owner, thus indicating an unauthorized entry or attempted entry into the secured object or container.

BRIEF DESCRIPTION OF THE PRIOR ART

Tamper indicating devices are well known in the patented prior art as evidenced by the U.S. patents to Simpson et al U.S. Pat. No. 4,516,679 and Cornell U.S. Pat. No. 3,935,960. The Simpson et al patent, for example, discloses a tamper-proof multi-layer wrap that includes chemical layers separated by a barrier. A puncture in the barrier as a result of tampering causes a subsequent chemical mixing resulting in a color change at the location of the puncture. Similarly, the Cornell patent discloses a sealed container having a closure including an indicator layer which changes color in response to handling or tampering of the closure.

While conventional tamper indicating seals operate somewhat satisfactorily, they possess certain inherent drawbacks with regard to reliability, sensitivity, durability, and cost. If a conventional seal is sensitive enough to reliably indicate attempted penetration, then it is likely to suffer from false alarms due to normal handling. Highly reliable seals are difficult to apply, expensive, and require laboratory-grade equipment to verify. Most conventional seals that are easy to apply are easy to surreptitiously remove as well. Furthermore, many conventional seals are easy to duplicate, and those that are not must be maintained under continuous security before use in order to prevent theft and substitution of other seals.

The present invention was developed in order to overcome these and other drawbacks of the prior tamper revealing seals by providing a seal which is easy to apply to an object, unique in its identification with respect to other seals, easily verifiable, and sensitive to penetration or other tampering but insensitive to stress from normal handling.

SUMMARY OF THE INVENTION

Accordingly, it is a primary object of the present invention to provide an improved tamper indicating seal for an object and a method for making the seal and indicating whether tampering has occurred. The improved seal includes a layer or volume of transparent material which is applied to at least a portion of the object and a plurality of particles of reflective material which are randomly arranged in a unique orientation within the layer of material. The particles produce a unique reflective pattern when they are illuminated by a source of light. Should tampering of the seal occur, the orientation of the particles within the layer of transparent material is altered, resulting in a change in the reflective pattern, thereby indicating tampering.

According to a more specific object of the invention the transparent material includes a plurality of micro-capsules each containing a dye. Upon penetration of the transparent material, at least one of the micro-capsules is broken to release the dye and provide a further indication of tampering.

According to a further object of the invention, a pattern generating device is provided for generating and preserving a pattern corresponding with the orientation of particles in the tamper indicating seal. The pattern generator includes a base connected with the object in a fixed orientation relative to the seal and a first cylindrical tube rotatably connected with the base about an axis extending normal to the surface of the object. A screen is arranged at the end of the tube opposite the seal. A second cylindrical tube is connected with the first tube at an adjustable angle relative to the first tube axis. At the remote end of the second tube, a light source is provided for generating collimated beams of light which pass through the second tube and the first tube to the seal where some of the beams of light are reflected from the particles through the first tube to generate a pattern on the screen. A permanent record of the pattern is then recorded.

BRIEF DESCRIPTION OF THE FIGURES

Other objects and advantages of the invention will become apparent from a study of the following specification when viewed in the light of the accompanying drawing, in which.

DETAILED DESCRIPTION

Figure 1:
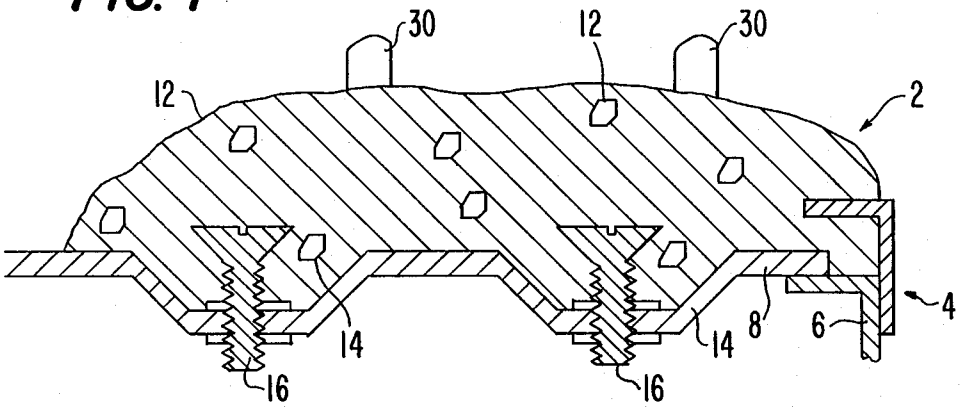
FIG. 1 is a sectional view of a joint between two walls of an object such as a container having a tamper indicating seal according to the invention arranged across the joint.

The improved tamper revealing seal according to the invention will be described initially with respect to FIG. 1. As shown therein, the seal 2 is applied in a layer to a portion of an object or container 4 which is vulnerable to penetration. The container 4 of FIG. 1, for example, includes a double side wall 6 and a cover 8, and the seal is provided on the surface of the cover and extends over the joint between the cover and the side wall.

The seal 2 is formed from a transparent material 10 such as acrylic plastic material which is resistant to heat, solvents, and stress. The plastic material is initially in a liquid state and contains a plurality of particles of reflective material 12 randomly arranged within the material before it hardens to a solid matrix. Other suitable transparent materials include glass, natural resins and the like which can be liquified for application and solidified for use.

The mixture is then poured onto the container to be sealed. A removable barrier (not shown) is normally provided about the perimeter of the seal area to confine the liquid mixture to the desired surface area. The container surface to be sealed preferably includes depressions 14 and retaining fixtures 16 so that the effectiveness of the seal does not depend upon its adhesion to the container surface. As shown in FIG. 1, the fixtures 16 may comprise machine screws mounted with their heads above the cover surface and resting in a countersink. The countersink makes it difficult to slide a thin saw or other sharp object between the seal and the cover surface to cut the retaining screws without also cutting the seal material that flows into the depressions.

After the seal is in place and after the transparent liquid material has hardened, the barrier is removed. The reflective particles are fixed in a random orientation, with the orientation being unique for each different seal.

One of the seal's primary tamper indicating features is due to the fact that the presence of the reflective particles somewhat weakens the transparent material. Thus if the seal is broken, the fracture tends to seek a path through the locations of the particles. The end result is that any attempt to solvent weld or fuse a broken seal is likely to be frustrated by particles which protrude from the fractured surfaces. If the protruding particles are removed, the resulting voids are immediately detected. If the protruding particles are not removed, they prevent the intimate contact necessary for an undetectable repair.

As set forth above, once the seal has hardened, the particles are fixed in a given orientation. Thus each seal comprises an essentially random distribution of optical reflectors, each oriented in a random direction. When the seal is illuminated, a reflective pattern or signature is generated corresponding with the orientation of the particles. Accordingly, each seal has its own characteristic signature or pattern which, if verified following handling, can be used to indicate that the seal has not been tampered with. If the reflected pattern from a seal does not correspond with its initial signature pattern, an indication of tampering is provided since the seal has been deformed in some fashion causing a reorientation of the particles from the unique initial orientation thereof. One advantage of the random particle orientation within the synthetic plastic material is that the resulting signature pattern is extremely difficult to duplicate.

Figure 2:
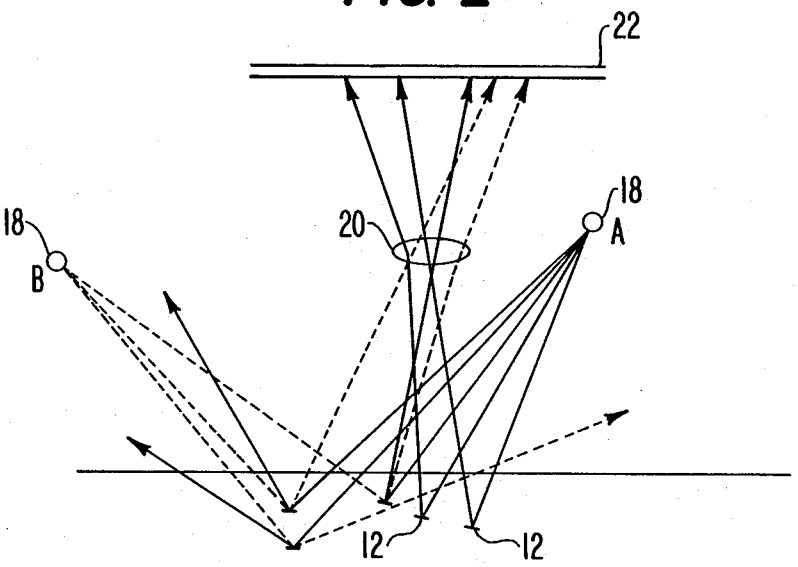
FIG. 2 is a schematic view of signature pattern generation from a tamper indicating seal.

FIG. 2 is a schematic illustration of a seal 2 and demonstrates the technique for initial seal signature pattern generation and subsequent pattern verification. When a collinated light source 18 at a first location A illuminates a quantity of seal material, some of the reflective particles 12 will direct a specular reflection of the light beams toward a lens 20 and screen 22 while other particles will direct reflections away from the lens and screen. Whether a specific particle reflects the light toward the screen 22 depends on that particle's orientation and upon the relative positions of the lamp, particle, and screen. Each particle's orientation is essentially random and different, whereby the pattern of bright spots generated on the screen produced by the particles of each seal is absolutely unique.

Figure 3:
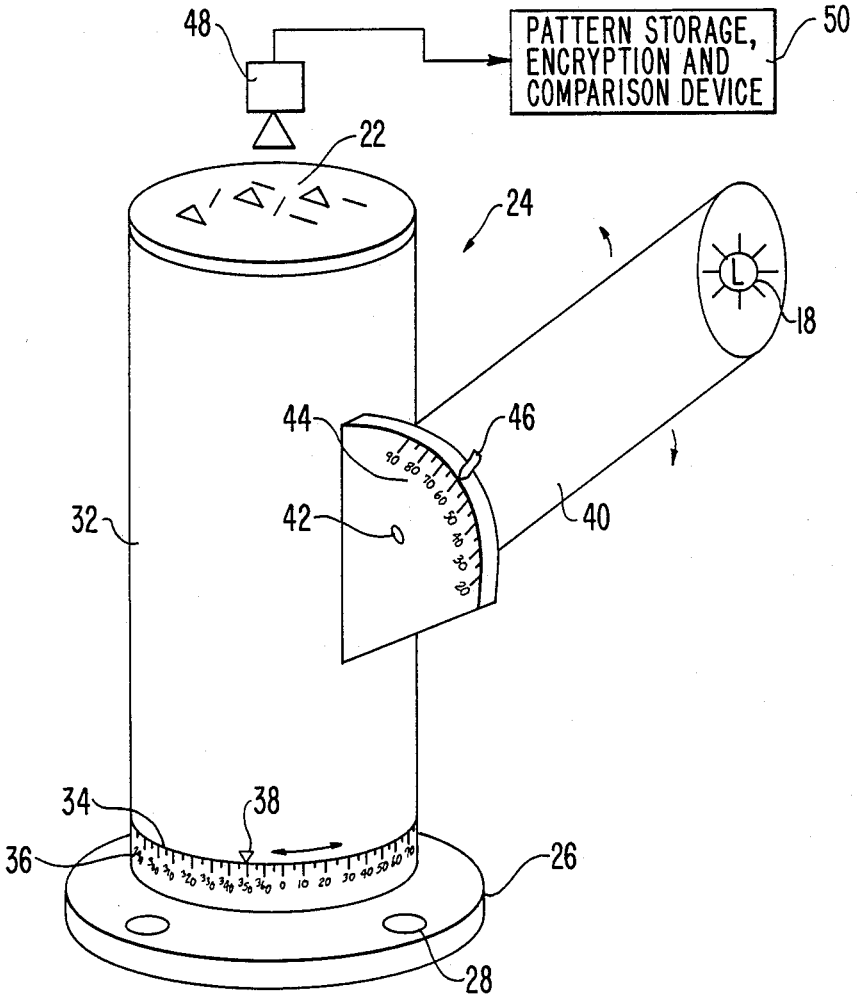
FIG. 3 is a perspective view of a device for generating a signature pattern corresponding with the orientation of reflective particles of a tamper indicating seal.

FIG. 3 illustrates a device 24 for characterizing and/or verifying the unique signature or pattern of a tamper indicating seal. The device comprises a base 26 which is connected with or temporarily mounted on the sealed object in a fixed and repeatable orientation relative to the seal. The base contains a plurality of openings 28 which are oriented to receive fixed pins 30 which protrude from the object 4 adjacent the seal 2 as shown in FIG. 1. Alternatively, the openings in the base may be arranged to receive the fastening devices 16 connected with the cover 8 of the object. A first cylindrical tube 32 is rotatably connected with the base by way of a bearing 34. The base 26 includes a scale 36 and the first tube includes a pointer 38, whereby the rotational position of the tube 32 relative to the base 26 can be determined and repeated if desired. The axis of the first tube 32 is arranged normal to the surface of the object at the location of the seal. The base 28 has an annular configuration and contains a central opening (not shown) having a diameter corresponding with the inner diameter of the tube. To characterize or verify a seal, the base is arranged over at least a portion of the seal as will be set forth in greater detail below.

At the end of the first tube opposite the base is provided a screen 22 which corresponds with that shown schematically in FIG. 2. Furthermore, a lens such as the lens 20 of FIG. 2 is axially arranged within the first tube. The lens has a focal length appropriate for focusing an image on the screen. The screen 22 comprises a translucent sheet of material such as paper supported by a transparent window attached to the end of the tube.

A second cylindrical tube 40 is pivotally connected with the first tube 32 by a bearing and bracket 42 for pivotal movement relative to the axis of the first tube 32. The bracket 42 includes a scale 44 and the second tube 40 contains a pointer 46 to indicate the angular orientation of the second tube 40 relative to the first tube 32 and to permit accurate resetting of the angular position the second tube. The second tube is open at its lower end for communication with the interior of the first tube, and a light source 18 is arranged within the upper end of the tube 40 for directing light rays through the second tube and the first tube to the seal where the reflective particles reflect a portion of the light through the lens to the screen where the pattern is produced.

With reference to the angular positions of the tubes as read on the scales 40 and 44, the paper screen 22 can ultimately serve as the seal verification record. The screen must be indexed to the pattern generating device 24 so that its precise orientation can be duplicated when it is removed. A recording system including a camera 48 and storage device 50 may be provided to read, encrypt, and store the original signature pattern of the seal as well as to read and compare a verification pattern of the seal with the original signature pattern to determine and indicate tampering with the seal when the patterns do not match.

Further assurance against seal duplication can be gained if a second characterization record is made of each seal with a different lamp orientation. Rotation of the first tube 32 about its axis and pivotal movement of the second tube 40 relative to the first tube repositions the lamp relative to the seal, with the base 26 remaining fixed. FIG. 2 schematically illustrates pattern generation of a seal with the lamp located at a second position B, with the light rays therefrom being represented by broken arrows. The generation of a backup pattern record takes advantage of the fact that any given two-dimensional reflection pattern can be generated by an infinite number of three-dimensional arrangements of reflective particles, but only one specific arrangement of particles can produce the same related pair of patterns with different lamp orientations.

In use, the seal must not be the strongest part of the object to be protected. Ideally, the seal should completely surround the protected object so that access to it is completely dependent upon defeating the seal. If the seal can not envelope the object completely, then it should cover all areas vulnerable to penetration and its signature or characterization record should include seal volumes from all such areas.

The size of the object to be protected will govern the size and nature of reflective particles required. If the object is very small such as an integrated circuit, then the particles should be very small and characterization and verification or inspection should take place under magnification.

More elaborate methods can be employed to provide increasing levels of confidence for tamper indicating seals. For example, stereoscopic or invisible light photography in conjunction with optical trace elements may be used for the light source. Photopolarimetry analysis of residual stress patterns in the transparent material may be used to insure that the seal has not been subjected to abnormal environments such as heat, cold, bending, or compression.

Furthermore, the reflective particles may have a generally planar configuration and comprise sections of diffraction gratings or holograms. Alternatively, three-dimensional reflectors or a mixture of reflective particles of different colors may be used.

To provide greater protection against penetration of the seal by drilling or the like, a plurality of microcapsules containing a solvent based dye are mixed within the transparent material in a sufficient quantity such that the smallest useful hole would have to pass through several of the microcapsules. When the capsules are broken, the dye etches an indelible stain into the hole, thus rendering attempted repairs highly visible.

While in accordance with the provisions of the Patent Statute the preferred forms and embodiments of the invention have been illustrated and described, it will be apparent to those skilled in the art that various changes and modifications may be made without deviating from the inventive concepts set forth above.

What is claimed is:

1. A tamper indicating seal for an object, comprising (a) a layer of transparent material applied to at least a portion of the object; and (b) a plurality of particles of reflective material randomly arranged within said layer of material, said particles producing a unique reflective pattern when illuminated by a source of light, whereby tampering of the layer of plastic material alters the orientation of said particles to produce a reflective pattern when illuminated which is different from said unique pattern, thereby to indicate tampering of the object.

2. A tamper indicating seal as defined in claim 1, wherein said transparent material is originally in a liquid state for receiving said particles of reflective material and for application to the object, following which said transparent material hardens to a solid matrix.

3. A tamper indicating seal as defined in claim 2, wherein said transparent material is resistant to heat, solvents, and stress.

4. A tamper indicating seal as defined in claim 3, wherein said transparent material comprises at least one of synthetic plastic, glass, or resin materials.

5. A tamper indicating seal as defined in claim 4, wherein said transparent material includes a plurality of micro-capsules each containing a dye, at least one of said micro-capsules being broken to release the dye upon penetration of said transparent material by a sharp instrument.

6. A tamper indicating seal as defined in claim 1, wherein said particles comprise generally planar sections of a diffraction grating.

7. A tamper indicating seal as defined in claim 1, wherein said particles comprise generally planar sections of a hologram.

8. A tamper indicating seal as defined in claim 1, wherein said particles have a three-dimensional polygonal configuration.

9. A tamper indicating seal as defined in claim 1, wherein said particles are colored.

10. A system for indicating tampering of an object, comprising (a) a seal applied to an area of the object vulnerable to penetration, said seal including (1) a layer of transparent material applied to the surface of the vulnerable area of the object; and (2) a plurality of particles of reflective material randomly arranged in a unique orientation within said layer of material; and (b) means for generating a pattern corresponding with the unique orientation of the reflective particles, whereby tampering with the seal alters the orientation of the reflective particles from said given orientation, thereby resulting in the generation of a pattern different from the pattern generated from the unique orientation of particles to indicate tampering of the object.

11. A tamper indicating system as defined in claim 10, wherein said pattern generating means comprises (a) a base connected with the object in a fixed orientation relative to the seal;

(b) a first cylindrical tube connected with said base, the axis of said tube extending normal to the surface of the object;

(c) a screen arranged at the end of said first tube opposite said seal;

(d) a second cylindrical tube adjustably connected with said first tube at an adjustable angle relative to said first tube axis;

(e) a light source arranged in said second tube adjacent an end remote from said first tube, said light source generating beams of light which pass through said second tube and said first tube to said seal where said light beams are reflected by said particles through said first tube to said screen to generate a pattern thereon.

12. A tamper indicating system as defined in claim 11, wherein said first tube is rotatably connected with said base for rotation about said first tube axis, and further wherein said second tube is connected with said first tube for pivotal movement about an axis normal to said rotation axis, whereby pivotal movement of said second tube and rotational movement of said first tube repositions said light source, thereby resulting in the generation of a second pattern corresponding with the orientation of the reflective particles.

13. A tamper indicating system as defined in claim 12, and further comprising means for recording said pattern corresponding with the unique orientation of particles in encrypted form.

14. A tamper indicating system as defined in claim 13, wherein said light source generates beams of collimated light.

15. A tamper indicating system as defined in claim 14, wherein said light source is stereoscopic for simultaneously generating at least two patterns of reflections.

16. A method for indicating tampering with the seal of an object, comprising the steps of (a) randomly mixing a plurality of particles of reflective material in a quantity of fluid transparent material;

(b) applying the fluid mixture of particles and transparent material to at least a portion of the object to form a seal, the mixture subsequently attaining a solid state with said random particles being arranged in a unique orientation having a reference reflection pattern, whereby a different orientation of particles from the unique orientation is indicative of tampering with the seal.

17. A method as defined in claim 16, and further comprising the step of illuminating the seal with a beam of light from a reference location to generate the reference reflective pattern.

18. A method as defined in claim 17, and further comprising the steps of (1) illuminating the seal a second time following handling of the object with a beam of light from the reference location to generate a second reflective pattern; and (2) comparing said reference pattern with said second pattern, whereby different patterns indicate different orientations of the reflective particles which in turn indicates tampering of the seal.

* * * * *